US010030339B2

(12) United States Patent
Martin

(10) Patent No.: US 10,030,339 B2
(45) Date of Patent: Jul. 24, 2018

(54) ROAD PAVER WITH ASPHALT FUME RISK REDUCTION SYSTEM

(71) Applicant: Caterpillar Paving Products Inc., Brooklyn Park, MN (US)

(72) Inventor: Guido Martin, Bologna (IT)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/660,223

(22) Filed: Jul. 26, 2017

(65) Prior Publication Data

US 2018/0030673 A1 Feb. 1, 2018

(30) Foreign Application Priority Data

Jul. 29, 2016 (EP) ..... 16181862

(51) Int. Cl.

| | |
|---|---|
| ***E01C 19/00*** | (2006.01) |
| ***E01C 19/17*** | (2006.01) |
| ***E01C 19/48*** | (2006.01) |
| ***B08B 15/00*** | (2006.01) |

(52) U.S. Cl.

CPC ..... *E01C 19/17* (2013.01); *B08B 15/00* (2013.01); *E01C 19/002* (2013.01); *E01C 19/48* (2013.01)

(58) Field of Classification Search

CPC ..... E01C 19/002; E01C 19/17; E01C 19/48; B08B 15/00

USPC ..... 404/72, 75, 111

See application file for complete search history.

(56) References Cited

U.S. PATENT DOCUMENTS

| | | | | |
|---|---|---|---|---|
| 4,519,711 | A | 5/1985 | Gillen et al. | |
| 5,470,176 | A | 11/1995 | Corcoran et al. | |
| 5,938,371 | A | 8/1999 | Gustin et al. | |
| 6,478,461 | B1 | 11/2002 | Frank | |
| 6,749,364 | B1 * | 6/2004 | Baker | E01C 19/288 404/118 |
| 7,094,001 | B2 | 8/2006 | Wills | |
| 8,500,363 | B1 | 8/2013 | Ries et al. | |
| 9,212,460 | B2 | 12/2015 | Komm et al. | |
| 2008/0196408 | A1 * | 8/2008 | Li | F01N 3/05 60/605.2 |

(Continued)

FOREIGN PATENT DOCUMENTS

| | | |
|---|---|---|
| DE | 102012007869 | 9/2013 |
| FR | 2667085 | 3/1992 |

(Continued)

OTHER PUBLICATIONS

H.C.A. Brandt & P.C. De Groot, "Un sistema di laboratorio per lo studio degli aspetti igienico-sanitari legati all'esposizione dei fumi di bitume", article, pp. 9-15, Rassegna del bitume, Rivista Del Siteb-Associazione Italiana Bitume Asfalto Strade, Estratto Dal No. 23/94.

(Continued)

*Primary Examiner* — Raymond W Addie

(57) ABSTRACT

A road paver comprises a screed assembly for laying a mat of paving material, and a tank for storing a coolant. The road paver further comprises a nebulizer device configured to receive the coolant from the tank and to nebulize the coolant into a coolant fog in an environment of the road paver. By cooling the environment of the road paver, the amount of harmful fumes emitted by hot paving material can be substantially reduced.

14 Claims, 2 Drawing Sheets

(56) References Cited

U.S. PATENT DOCUMENTS

| | | | |
|---|---|---|---|
| 2009/0056651 | A1 | 3/2009 | Frelich et al. |
| 2014/0363231 | A1 | 12/2014 | Bartoszek |

FOREIGN PATENT DOCUMENTS

| | | |
|---|---|---|
| IT | 1248987 | 2/1995 |
| JP | 2011140784 | 7/2011 |
| WO | 2007043966 | 4/2007 |

OTHER PUBLICATIONS

"L'esposizione al bitume e ai suoi fumi: effetti sulla salute", article, pp. 49-60, Rassenga del bitume, Rivista Del Siteb-Associazione Italiana Bitume Asfalto Strade, Estratto Dal No. 46/04.

* cited by examiner

ROAD PAVER WITH ASPHALT FUME RISK REDUCTION SYSTEM

TECHNICAL FIELD

The present disclosure generally relates to the field of road construction. More particularly, the present disclosure relates to a road paver, and a method for operating a road paver.

BACKGROUND

Paving machines (also referred to as road pavers and asphalt finishers) are commonly used to apply, spread and compact a paving, i.e., a mat of asphalt (bitumen) material, relatively evenly over a work surface. These machines are generally used in the construction of roads, parking lots and other areas. An asphalt paving machine generally includes a hopper for receiving asphalt material from a truck, a conveyor system for transferring the asphalt rearwardly from the hopper for discharge onto a roadbed, and a set of augers to evenly spread the paving material in front of a screed plate. The screed plate smoothes and compacts the asphalt material, ideally leaving behind a mat of uniform depth, density, texture and smoothness.

One noticeable disadvantage inherent with the use of asphalt is that the petroleum distillates in the asphalt tend to emit fumes including substantial amounts of hydrocarbon, particularly polycyclic aromatic compounds. These polycyclic aromatic compounds (PAC) are capable of causing harm to the operators of the asphalt paving machine and other construction personnel in the immediate vicinity of the paving machine.

An exemplary fumes abatement system for a road paver with a screed is disclosed in U.S. Pat. No. 5,938,371 A of Caterpillar Paving Products. The fumes abatement system dispels noxious fumes that are emitted from asphalt in the hopper of and from behind the paving machine during paving operations. The fumes abatement system utilizes existing plate walls of the feeder tunnel and superstructure to eliminate additional parts and for increased durability. A high capacity blower and a tall exhaust stack are used to disperse the fumes well above the operators of the machine.

For a so-called spray paver, which sprays a liquid of rubber-asphalt onto a surface at a temperature around 200° C., U.S. Pat. No. 7,094,001 B2 discloses a method and system for controlling malodorous emissions that form during spraying the rubber-asphalt onto the surface. The method includes spraying an asphalt substance onto the surface while moving over the surface, and releasing a liquid agent so that molecules of the liquid agent mix with molecules of the emission-causing substance. The liquid agent is pressurized before being released, and therefore forms a mist. This mist mixes with the emission-causing substance either on the surface or in the air space above the surface. The system includes an outlet for releasing a liquid agent, wherein the outlet is positioned to mix odor-controlling molecules with asphalt substance molecules.

The present disclosure is directed, at least in part, to improving or overcoming one or more aspects of prior systems.

SUMMARY OF THE DISCLOSURE

In one aspect of the present disclosure, a road paver is disclosed. The road paver comprises a screed assembly configured to lay a mat of paving material, and a tank configured to store a coolant. The road paver further comprises a nebulizer device configured to receive the coolant from the tank and to nebulize the coolant into a coolant fog in an environment of the road paver.

In another aspect, the present disclosure relates to a method for operating a road paver including a screed assembly. The method comprises operating the screed assembly to lay a mat of paving material. The method further comprises nebulizing a coolant into a coolant fog in an environment of the road paver. The method further comprises cooling air in the environment of the road paver by evaporative cooling affected by the coolant fog.

Other features and aspects of this disclosure will be apparent from the following description and the accompanying drawings.

BRIEF DESCRIPTION OF THE DRAWINGS

The accompanying drawings, which are incorporated herein and constitute a part of the specification, illustrate exemplary embodiments of the disclosure and, together with the description, serve to explain the principles of the disclosure. In the drawings.

DETAILED DESCRIPTION

Figure 1:
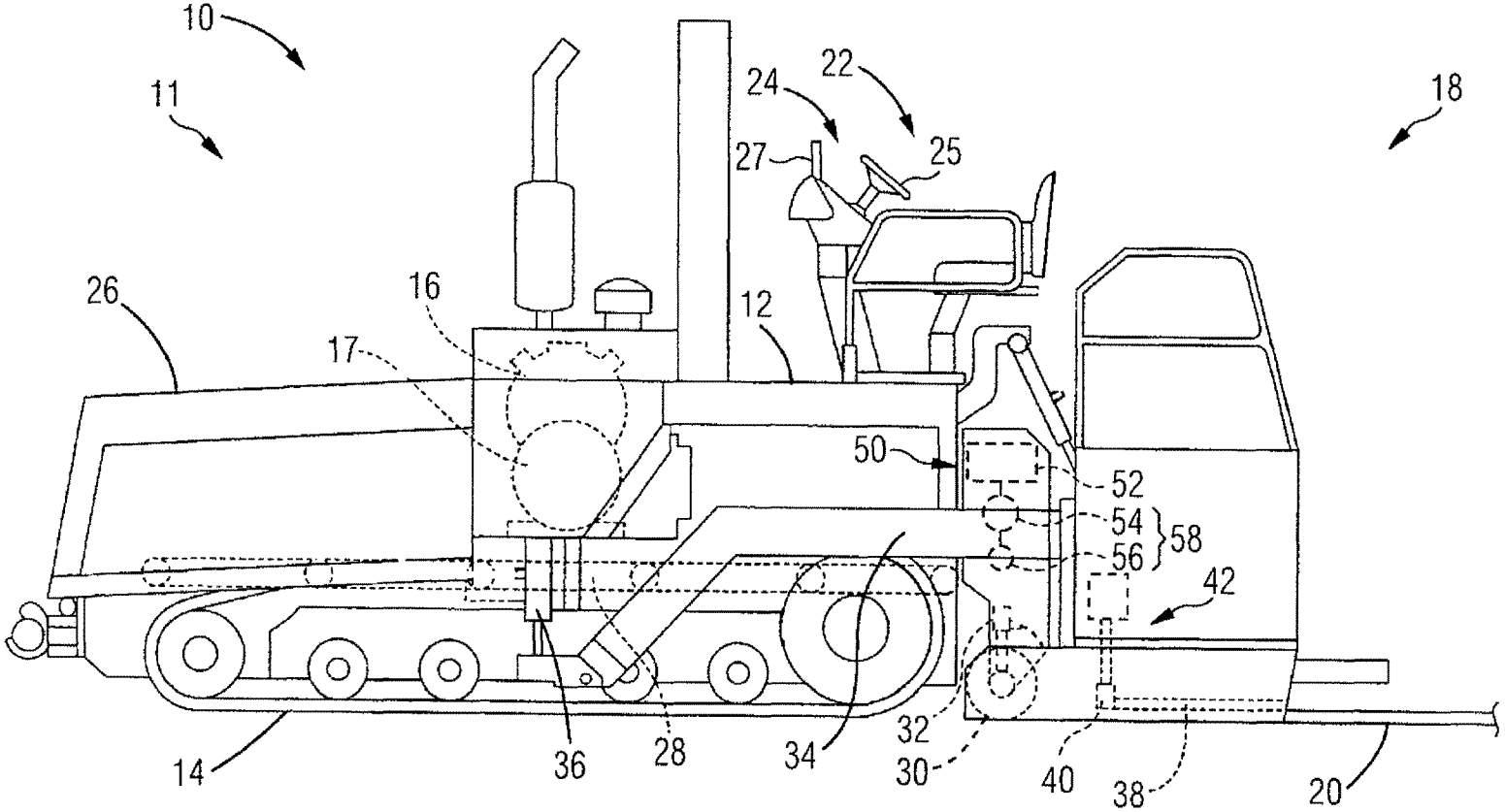
FIG. 1 is a diagrammatic side view of a road paver according to the present disclosure.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The present disclosure is based in part on the realization that by cooling the air above the augers, which are used for spreading hot paving material in front of the tamper and the screed plate, the amount of harmful fumes emitted by the hot paving material can be substantially reduced. Further regions at and around the road paver, for example to the longitudinal sides of the road paver and the rear of the road paver, may be also suitable cooling regions to further reduce the amount of harmful fumes.

A further reduction of fumes may be achieved by condensing gaseous components originating from the paving material and/or reducing evaporation of components of the paving material as a result of a selective cooling of desired regions.

The present disclosure is further based in part on the realization that a coolant fog, particularly a water fog, in the region to be cooled is particularly suitable for providing the desired amount of cooling. The coolant fog is able to substantially cool the region to be cooled by evaporative cooling. The cooling effect is particularly strong if providing the coolant fog with a specified droplet size as explained in further detail herein. Further, the coolant fog may form a barrier for gaseous components rising from the paving material.

Referring to FIG. 1, a road paver (asphalt finisher) 10 includes a tractor 11 towing a floating screed assembly 18.

The tractor 11 includes a frame 12 with a set of ground-engaging elements 14 such as wheels or tracks coupled with the frame 12. The ground-engaging elements 14 may be driven by an engine 16 in a conventional manner. The engine 16 may further drive an associated generator 17 that can be used to power various systems on the road paver 10 and the screed assembly 18.

The screed assembly 18 is attached at the rear end of the tractor 11 to spread and compact paving material into a mat 20 having a desired shape, thickness, texture, width, density and smoothness. The road paver 10 also includes an operator station 22 having a seat and an operator interface 24, which includes various controls for directing operations of the road paver 10.

The operator interface 24 includes a plurality of control and indication elements for the operator to allow monitoring and controlling operation of the road paver 10. For example, the operator interface 24 may include a steering wheel for steering the road paver 10. The interface 24 may include a display device 27 for outputting information to the operator.

The road paver 10 further includes a hopper 26 for storing paving material, and a conveyor system including one or more conveyors 28 configured to move paving material from the hopper 26 to the screed assembly 18 at the rear of the road paver 10.

One or more augers 30 are arranged near the forward end of the screed assembly 18 to receive the paving material supplied by the conveyor 28 and spread the material evenly in front of the screed assembly 18. The height of the augers 30 is adjustable via one or more height adjustment actuators 32, for example, hydraulic cylinders.

The screed assembly 18 may be pivotally connected behind the tractor 11 by a pair of tow arms 34 (only one of which is shown in FIG. 1) that extend between the frame 12 of the tractor 11 and the screed assembly 18. The tow arms 34 are pivotally connected to the frame 12 such that the relative position and orientation of the screed assembly 18 relative to the frame 12 and to the surface being paved may be adjusted by raising or lowering the tow arm actuators 36, for example, in order to control the thickness of the paving material deposited by the road paver 10. To this end, tow arm actuators 36 are provided that are arranged and configured to raise and lower the tow arms 34 and thereby raise and lower the screed assembly 18. The tow arm actuators 36 may be any suitable actuators, for example, hydraulic cylinders.

The screed assembly 18 may have any of a number of configurations known in the art. For example, it may be a single or multiple section screed. In some embodiments, the screed assembly 18 may include a screed extension provided adjacent to each of the left and right main screed sections. The screed extensions may be slideably movable laterally between retracted and extended positions such that varying widths of paving material can be laid. The lateral movement of the extensions may be driven by respective screed width actuators such as hydraulic or electric actuators. It should be noted, however, that in other embodiments the screed extensions may be omitted.

The screed assembly 18 also includes a screed plate 38, and a tamper device 42 positioned forward of the screed plate 38. The tamper device 42 extends transversely to the direction of travel of the road paver 10. A tamper bar 44 of the tamper device 42 cyclically acts on the laying material with essentially vertical strokes and a selectable stroke length.

The road paver 10 further comprises a cooling system 50. The cooling system 50 includes a tank 52, a pump 54, and at least one spray bar 56. The pump 54 and the at least one spray bar 56 together function as a nebulizer device (atomizer device) 58 that is configured to receive a coolant from the tank 52 and to nebulize the coolant into a coolant fog in an environment of the road paver 10 as is described in greater detail hereinbelow with reference to FIG. 2.

Figure 2:
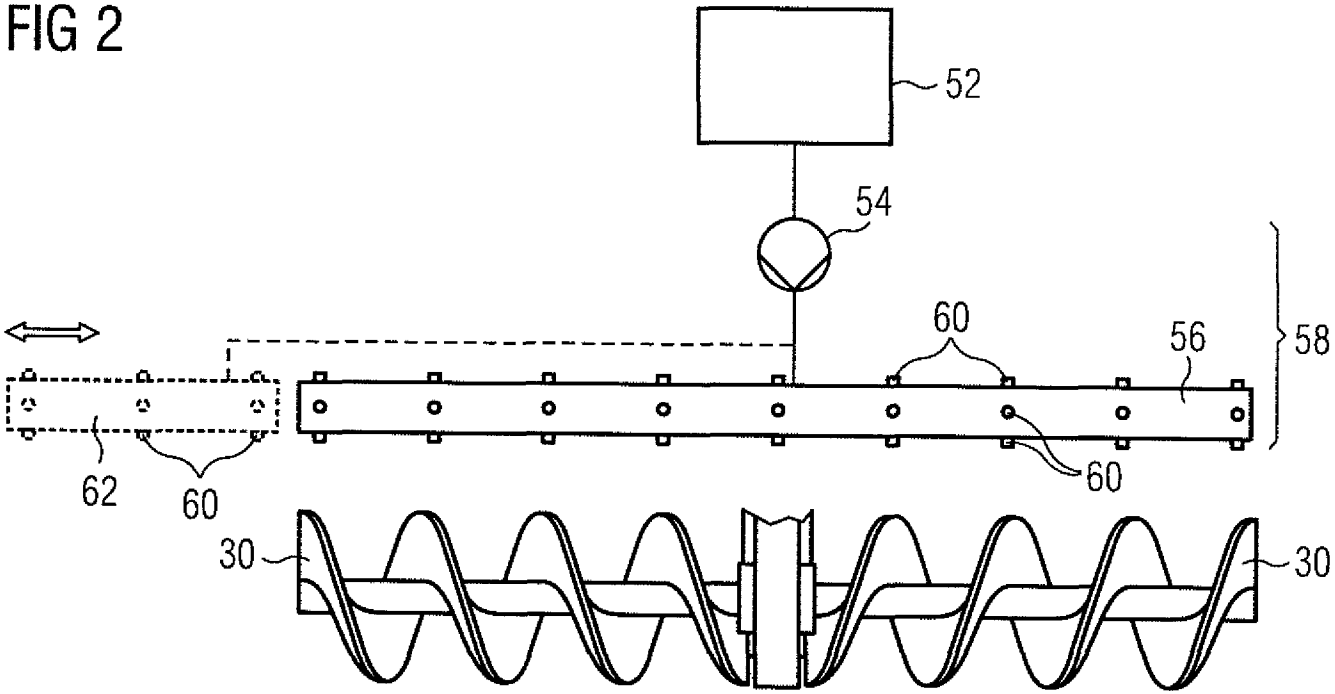
FIG. 2 is a schematic view of a nebulization device according to the present disclosure.

Referring to FIG. 2, the tank 52, the nebulizer device 58, and a set of two augers 30 is schematically shown.

The tank 52 is configured to store a coolant (fluid). The tank 52 includes an inlet for filling the tank with the coolant, and an outlet fluidly connected to the pump 54 for providing the coolant. The tank 52 may be disposed on the screed assembly 18 or the tractor 11.

The pump 54 is arranged to receive the coolant from the tank 52, and provides the coolant to one or more spray bars 56. In some embodiments, the pump 54 may be disposed on the tractor 11 or the screed assembly 18. For example, the pump 54 may be an electric pump.

In the following, the exemplary embodiment is described with reference to an example, in which the coolant is water (only), which may further include preservatives and/or agents for reducing a surface tension and/or softening agents. It was found that water is particularly suitable for nebulizing and producing a water fog that cools the air by evaporative cooling due to the physical properties of water (evaporation temperature, evaporation enthalpy, evaporation pressure, realizable droplet size, etc.). However, as one skilled in the art will appreciate, coolants other than water may be used, particularly coolants having similar physical properties as water, and coolants having no negative environmental influences.

As can be seen in FIG. 2, the spray bar 56 is arranged above the augers 30 which spread the paving material evenly in front of the screed assembly 18 (see FIG. 1). During operation, the hot paving material laid in front of the screed assembly 18 by the augers 30 emit fumes including substantial amounts of hydrocarbon, particularly polycyclic aromatic compounds. The spray bar 56 releases the water from the tank 52 in the form of a water fog. Specifically, a configuration of a plurality of atomizer nozzles 60 provided as outlets of the spray bar 56, and a pressure level provided by the pump 54 cooperate to nebulize the water into a water fog above and around the augers 30. For providing the water fog above the augers 30, a plurality of the atomizer nozzles 60 is directed to a region above the augers 30. For example, the atomizer nozzles 60 may be configured as orifices of the spray bar 56.

The water fog cools the air above and around the augers 30 by evaporative cooling. It was found that a droplet size (droplet diameter, for example average diameter, Martin diameter, Ferret diameter) smaller than about 100 μm, particularly within a range between about 10 μm and about 40 μm (for example, measured by an optical measuring method), is particularly suitable for achieving the desired amount of evaporative cooling. That is, the atomizer nozzles 60, the spray bar 56 and the pump 54 cooperate to provide the desired droplet size as noted above. Suitable configurations may include, but are not limited to, pump 54 pressures above about 50 bar, for example within a range between about 60 bar and about 70 bar. Further, the opening diameters of the atomizer nozzles 60 may be within a range around the desired droplet sizes, for example the opening diameters may be smaller than about 200 μm, particularly within a range between about 20 μm and about 80 μm.

The environment of the augers 30 is cooled by the evaporative cooling (wet air cooling) provided by the water fog in the air. Specifically, the small water droplets are evaporated in the air and hot fumes. As a result, the temperature of the air and the fumes drop significantly through the phase transition of liquid water (droplets) to water vapor (evaporation), which requires thermal energy in the amount of the vaporization enthalpy of the water. Particularly, it was found that a reduced ambient temperature, and thus a reduced fume temperature, may significantly reduce the amount of polycyclic aromatic compounds in the fumes.

Further, the water fog may be produced to such an extent that the respective evaporative cooling substantially condenses the gaseous components originating from the paving material mat laid by the screed assembly 18, particularly polycyclic aromatic hydrocarbons, from the air.

Additionally, the water fog may be produced to extend (also) just above the surface of the paving material for cooling the surface by evaporative cooling to such an extent that evaporation of components from the paving material, particularly polycyclic aromatic hydrocarbons, is reduced.

Still further, the water fog may be produced to form a barrier for gaseous components emitted from the paving material so that the emitted gaseous components are substantially hindered from rising above the water fog.

The water fog provided in the environment of the augers 30 serves to prevent that construction personnel in the immediate vicinity of the augers 30 are exposed to the harmful fumes. Accordingly, it is particularly desirable to provide the water fog below a head height of construction personnel walking next to the road paver 10 to form the barrier for the gaseous components without reducing the visibility for the construction personnel. For example, the water fog may substantially extend until a height of about 1.50 m, particularly about 1.0 m, more particularly until about 0.5 m to 0.7 m. The height is measured in a vertical direction from a top surface of the laid mat of paving material.

In some embodiments, the spray bar(s) 56 may include a plurality of atomizer nozzles 60 directed into a plurality of differing radial directions with respect to a longitudinal direction of the spray bar(s) 56. For example, providing atomizer nozzles 60 around the entire circumference of the spray bar 56 allows to produce a water fog around the spray bar 56 instead of providing a water fog to one side of the spray bar 56 only.

In some embodiments, at least one spray bar 56 may be arranged at a longitudinal side of the road paver 10, for example mounted to one or both longitudinal sides of the tractor 11 or the screed assembly 18. In those embodiments, the produced water fog helps to prevent inhaling of the fumes by construction personnel walking next to the longitudinal sides of the road paver 10, and the operator of the road paver 10 sitting in the operator station 22.

Additionally or alternatively, at least one spray bar 56 may be arranged at a rear side of the road paver 10, for example mounted to a rear end of the tractor 11 above conveyor 28 or a rear end of the screed assembly 18, to protect workers at the rear of the road paver 10.

Furthermore, in some embodiments, at least one spray bar 62 (indicated with dashed lines in FIG. 2) may be mounted to the tractor 11 or the screed assembly 18 to be movable, for example movable in a longitudinal direction of the spray bar 62. For instance, the movable spray bar 62 may be provided in embodiments with extendable screed sections so that the movable spray bar 62 can follow the extendable screed section to provide a water fog also above extended augers etc. In the retracted state, the movable spray bar 62 may be retractable to a position to a side (above, below, etc.) of the stationary spray bar 56 provided above the stationary auger 30.

Additionally or alternatively, at least one spray bar may be extendable (not shown in the FIGS.), for example in the form of a telescopic spray bar, to ensure that outer end atomizer nozzles of the extendable spray bar produce a water fog also above the outer ends of the extended augers.

A control system may be provided to adjust an extension state of a movable and/or extendable spray bar 62 with an extension state of an extendable screed assembly 18 with extendable augers 30. In other words, the position and/or extension of the produced water fog may be based on an actual paving width of the road paver 10. Thereby, a position and/or extension of a produced water fog may be matched with a position of fumes rising from the hot paving material.

The nebulizer device 58 may further comprise one or more fans (not shown in the FIGS.) for directing a produced water fog into a desired direction, for example in direction to a region above the auger 30.

It is further noted that the water fog produced by the nebulizer device 58 may also help to create a cool environment for workers at and around the road paver 10 on particularly hot days.

In some embodiments, the road paver 10 may further comprise individual or all features of the fumes abatement system as disclosed in U.S. Pat. No. 5,938,371 A of Caterpillar Paving Products, which is incorporated herein by reference with respect to the plurality of disclosed embodiments of the fumes abatement system, and its integration in the paver.

In some embodiments, the road paver 10 may further comprise individual or all features of the cooling system as disclosed in US 2009/0056651 A1 of Caterpillar Paving Products, which is incorporated herein by reference with respect to the plurality of disclosed embodiments of the cooling system, and its integration in the paver.

INDUSTRIAL APPLICABILITY

The nebulizer device as disclosed herein is applicable as a cooling device for cooling an environment of a road paver for reducing an amount of harmful fumes emitted from the hot paving material during operation of the road paver. Particularly, a spray bar of the nebulizer device may be provided in the vicinity of at least one auger to provide a coolant fog, particularly a water fog, above and/or around the auger.

Terms such as "about", "around", "approximately", or "substantially" as used herein when referring to a measurable value such as a parameter, an amount, a temporal duration, and the like, is meant to encompass variations of ±10% or less, preferably ±5% or less, more preferably ±1% or less, and still more preferably ±0.1% or less of and from the specified value, insofar as such variations are appropriate to perform in the disclosed invention. It is to be understood that the value to which the modifier "about" refers is itself also specifically, and preferably, disclosed. The recitation of numerical ranges by endpoints includes all numbers and fractions subsumed within the respective ranges, as well as the recited endpoints.

Although the preferred embodiments of this invention have been described herein, improvements and modifications may be incorporated without departing from the scope of the following claims.

The invention claimed is:

1. A road paver comprising:

a screed assembly configured to lay a mat of paving material;

a tank configured to store a coolant, and a nebulizer device configured to receive the coolant from the tank and to nebulize the coolant into a coolant fog in proximity of the screed assembly of the road paver.

2. The road paver of claim wherein the nebulizer device is configured to nebulize the coolant into a coolant fog having a droplet size smaller than about 100 μm.

3. The road paver of claim 1, wherein the road paver further comprises an auger for distributing the paving material, and the nebulizer device is configured to nebulize the coolant into a coolant fog in a region above the auger.

4. The road paver of claim 1, wherein the nebulizer device is further configured to be movable or extendable.

5. The road paver of claim 1, wherein the coolant is water, and the nebulizer device configured to nebulize the water into a water fog.

6. The road paver of claim 1, wherein the nebulizer device further comprises:

a pump fluidly connected to the tank; and a spray bar fluidly connected to the pump to receive the coolant from the tank via the pump, the spray bar including a plurality of atomizer nozzles.

7. The road paver of claim 6, wherein at least one of the atomizer nozzles is directed to a region above an auger of the road paver.

8. The road paver of claim 6, wherein the atomizer nozzles are directed into a plurality of differing radial directions with respect to the spray bar.

9. The road paver of claim 6, wherein the nebulizer device comprises an extendable and movable spray bar.

10. A method for operating a road paver including a screed assembly, the method comprising:

operating the screed assembly to lay a mat of paving material;

nebulizing a coolant into a coolant fog in proximity of the screed assembly of the road paver; and cooling air in an environment of the road paver by evaporative cooling affected by the coolant fog.

11. The method of claim 10, wherein the method step of cooling air in the environment of the road paver by evaporative cooling affected by the coolant fog includes cooling the air to:

condense gaseous components originating from the paving material, particularly polycyclic aromatic hydrocarbons, and reduce evaporation of components of the paving material, particularly polycyclic aromatic hydrocarbons.

12. The method of claim 10, wherein the step of nebulizing a coolant into a coolant fog comprises producing the coolant fog to substantially extend until a height of about 1.50 m, the height being measured in a vertical direction from a top surface of the laid mat of paving material.

13. The method of claim 10, further comprising:

adjusting a position and extension of the produced coolant fog based on an actual paving width of the road paver.

14. The method of claim 10, wherein the step of nebulizing a coolant into a coolant fog comprises producing the coolant fog to form a barrier for gaseous components rising from the paving material.

* * * * *